United States Patent [19]

Haas

[11] 4,017,343

[45] Apr. 12, 1977

[54] METHOD OF AND APPARATUS FOR ETCHING

[75] Inventor: Rainer Haas, Herrenberg, Germany

[73] Assignee: Firma Hans Hollmuller, Maschinenbau, Gultstein near Herrenberg, Germany

[22] Filed: July 15, 1975

[21] Appl. No.: 596,001

[30] Foreign Application Priority Data

July 17, 1974 Germany ..... 2434305

[52] U.S. Cl. ..... 156/642; 134/10; 134/109; 156/345

[51] Int. Cl.[2] ..... C23F 1/00

[58] Field of Search ..... 34/10, 108, 109; 156/19, 345

[56] References Cited

UNITED STATES PATENTS

| | | | |
|---|---|---|---|
| 3,082,774 | 3/1963 | Benton et al. | 156/345 X |
| 3,310,435 | 3/1967 | Robinson et al. | 134/41 X |
| 3,871,914 | 3/1975 | Goffredo et al. | 134/109 |

*Primary Examiner*—William A. Powell
*Attorney, Agent, or Firm*—Karl F. Ross; Herbert Dubno

[57] ABSTRACT

A workpiece is passed through an etching tank, and then through at least an upstream rinsing tank and a downstream rinsing tank. In each of the tanks a respective liquid is pumped up from a sump at the bottom and sprayed over the workpiece as it passes through. Liquid is drawn out of the upstream rinse tank and mixed with regenerator chemicals to replenish liquid lost by the etcher and maintain the liquid in the etcher at full strength. Liquid lost from the upstream rinser in this manner is replenished by introduction into the downstream rinser of fresh water and passage of liquid from the downstream rinser to the upstream rinser through an overflow that maintains a higher liquid level in the downstream rinser than in the upstream rinser.

8 Claims, 1 Drawing Figure

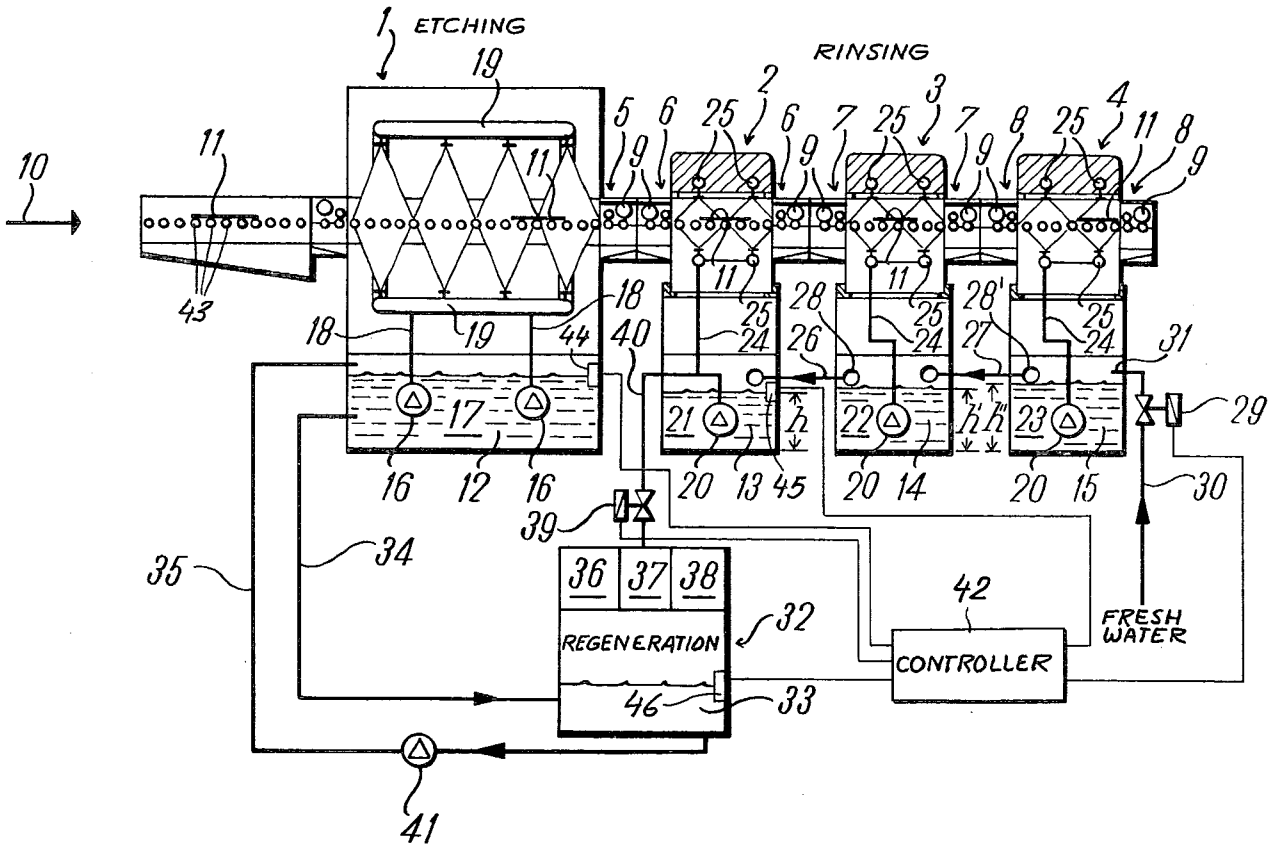
ETCHING
RINSING
FRESH WATER
CONTROLLER
REGENERATION

METHOD OF AND APPARATUS FOR ETCHING

CROSS-REFERENCE TO RELATED APPLICATIONS

This application is related to my copending patent application Ser. No. 386,021 filed on Aug. 6, 1973, now U.S. Pat. No. 3,933,544 as a division of my earlier application Ser. No. 230,871 filed on Mar. 1, 1972 (now U.S. Pat. No. 3,806,393).

FIELD OF THE INVENTION

The present invention relates to a method of an apparatus for etching a workpiece. More particularly this invention concerns the operation of a machine for etching a metallic workpiece.

BACKGROUND OF THE INVENTION

It is known to etch metallic, e.g., copper, workpieces with a liquid, e.g., an ammonium acid, by passing the workpiece through a treatment tank in which the etchant liquid is sprayed over the workpiece. The liquid draining off the workpiece falls into a sump at the bottom of the etchig tank and is recirculated by a pump. Thereafter the workpiece passes into a rinsing tank where it is rinsed with a liquid such as fresh water which is sprayed and recirculated like the etchant liquid.

The principal disadvantage of such systems is that the etchant liquid is continuously weakened, while at the same time the rinse liquid becomes increasingly contaminated. For this reason it is necessary to periodically drain off part of the etchant liquid and replace it with full-strength etchant in order to maintain proper strength. In the same manner part of the rinse liquid is replaced with fresh water, with a filter normally being interposed in the circulation system for the rinse liquid. Thus it is necessary to dispose of the drawn-off portions of etchant liquid and rinse liquid. Since both of these liquids are contaminated with metal particles and acids it is necessary to neutralize and purify them before disposal, a costly operation that greatly increases the overall expense of etching.

OBJECTS OF THE INVENTION

It is therefore an object of the present invention to provide an improved method of an apparatus for etching a metal.

Another object is the provision of such an apparatus wherein the above-described pollution problem is largely avoided.

SUMMARY OF THE INVENTION

These objects are obtained in accordance with the present invention in the system wherein etchant liquid lost from the etcher is replaced by regenerator chemicals and rinse liquid drawn out of the rinser. The rinse liquid lost from the rinser is replaced by fresh water. Thus in accordance with the present invention there is virtually no waste liquid to dispose of, most of the liquid lost from the system being attributable to evaporation.

According to yet another feature of this invention several such recirculating rinsers are provided downstream from the etching tank. Rinse liquid is drawn out of the furthest upstream rinser and is used to dilute the regenerator chemicals that are added to the etchant liquid, and fresh water is added to the extreme downstream rinser tank. Overflows are provided between the rinse tanks so that, in effect, the fresh water and rinse liquid flows countercurrent to the workpiece, that is fresh water is introduced into the furthest downstream rinser and the slightly contaminated rinse liquid from this rinser is used to replenish the rinse liquid in the next upstream rinser and so on. With this arrangement it is possible almost completely to eliminate the above-described pollution problem. At the same time very good results are obtained as the etchant is maintained very strong and the rinsing is complete, as the furthest downstream rinser uses virtually pure fresh water.

With the system according to the present invention the amount of etchant and fresh water used is directly dependent on the number of workpieces being processed and their size. This is due to the fact that the only noticable etchant loss is due to etchant liquid being carried away by workpieces, so that if no workpieces are being treated the only losses are due to evaporation from the treatment tank, a nominal amount. Furthermore the use of the water from the furthest upstream rinse tank in the regenerator makes regeneration of the etchant relatively easy as this rinse liquid is highly contaminated and therefore already acidic.

In accordance with the present invention and rinse tanks are all in a row in the transport direction and each is connected to the upstream tank via an overflow. The overflows are so arranged that the liquid level in each tank is lower than that of the downstream tank, if any, and higher than that of the upstream tank, if any. This ensures that there will be countercurrent flow of rinse liquid from the less contaminated sumps to the more contaminated sumps.

According to a further feature of this invention the apparatus is provided with a controller connected to a valve in a fresh-water feed line connected to the furthest downstream rinser and to another valave connected between the circulating pump of the furthest upstream rinser and the regenerator.

According to yet another feature of this invention means is provided between the etcher and the furthest upstream rinser and downstream of each rinser for stripping liquid from the workpiece. In this manner minimum liquid exchange from tank to tank is possible.

BRIEF DESCRIPTION OF THE DRAWING

The above and other objects, features, and advantages will become more readily apparent from the following, reference being made to the accompanying drawing whose sole FIGURE is a side-elevational view diagrammatically representing the system according to the present invention.

SPECIFIC DESRIPTION

The arrangement according to the present invention has an etcher 1 followed by an upstream rinser 2, an intermediate rinser 3, and a downstream rinser 4. Immediately downstream of the etcher 1 is a liquid-stripping arrangement 5. Similar such arangements 6, 7, and 8 all have squeezing rollers 9 are provided at the respective rinsers 2, 3, and 4.

A workpiece 11 is passed in a transport direction 10 through the etcher 1 and rinsers 2, 3, and 4 on rollers 43. The etcher 1 and rinsers 2, 3, and 4 are provided with respective sumps 12, 13, 14, and 15.

In the etcher 1 a pair of pumps 16 located in the sump 12 serve to take in liquid 17 in this sump 12, and pump it up through conduits 18 to upper and lower arrays 19 of sprayers that serve to saturate the workpiece 11 as it passes through the etcher 1 on the rollers 43. Similar such pumps 20 are provided in each of the rinsers 2, 3, and 4 to pump the respective liquids 21, 22, and 23 up through conduits 24 to similar upper and lower spraying arrangements 25.

The liquid 21 in the upstream rinser 2 has a level *h* and is introduced into this sump 13 through a conduit 26 having an inlet end 28 at the upper part of the sump 14. The liquid 22 in the sump 14 is maintained at a liquid level *h'* sightly higher than the level *h* due to the position of the orifice 28. A similar conduit 27 connects the sumps 14 and 15 together and has an inlet hole 28' which serves to maintain a level *h''* sightly higher tha the level *h'* in the sump 15.

Fresh water is fed into the downstream rinser 4 from a conduit 30 having an outlet end 31 and provided with an electromagnetic valve 39.

A regenerator 32 has a sump 33 connected via a pair of ciculating lines 34 and 35 to the sump 12 of the etcher 1. A pump 41 in the line 35 operates continuously to circulate the etchant liquid 17 between the sumps 12 and 33. Three suplies 36, 37, and 38 of regenerator chemicals as described in the above-mentioned related applications are provided in the tank 32 and are operated by means known per se to maintain the liquid in the sump 33 at a predetermined strength. An electromagnetic valve 39 is provided in a line 40 extending between the pressure line 24 from the pump 20 of the rinser 2 to the chemical supplies 36, 37, and 38.

A controller 42 is connected to three level sensors 44, 45, and 46 respectively in the sumps 12, 13, and 33. In addition this controller 42 is connected to the valves 29 and 39 and to the pump 41. As the system operates the controller 42 serves to maintain the level in the sump 33 even by adjusting the rate of operation of the pump 41. In addition whenever the level in the sump 17 drops below a predetermined level it opens the valve 39 so as to conduct the fluid 21 from this sump 13 into the sump 33 and cause the pump 41 to operate more rapidly so as indirectly to raise the level in the sump 12. I addition whenever the level in the sump 13 fals below a predetermined level, either due to depletion through the conduit 40 or carrying of the liquid 21 by the workpieces 11, the controller 42 opens the valve 29 so as to admit fresh water into the downstream sump 15 which will then flow through the overflow conduit 27 to the sump 14 and then through the overflow conduit 26 into the sump 13 to replenish same.

I claim:

1. A method of etching a workpiece comprising the steps of:

circulating an etchant liquid in a closed etchant path over said workpiece and through an etchant sump, thereafter circulating a rinse liquid in a closed rinse path over said workpiece and through a rinse sump, withdrawing from said rinse sump a portion of said rinse liquid and introducing said portion into said etchant path along with a regenerator to replace lost etchant liquid and restore the strength thereof, introducing into said rinse path a quantity of fresh water of volume substantially equal to that of said portion of rinse water withdrawn, said rinse water by circulating through a pair of such rinse paths each having a respective sump and spaced apart in a transport direction, said fresh water being added to the downstream rinse path and said portion being withdrawn from the upstream rinse path;

successively passing said workpiece in said direction through said etchant path, then through said upstream rinse path, and then through said downstream rinse path; and automatically withdrawing from the downstream sump and introducing into the upstream sump a quantity of rinse liquid of volume substantially equal to that of said portion on withdrawal thereof from said upstream sump.

2. The method defined in claim 1, further comprising the steps of substantially stripping said liquids from said workpiece betwen said paths and returning said lliquids to their respective sumps.

3. The method defined in claim 1 wherein rinse liquid is withdrawn from said downstream rinse path and introduced into said upstream rinse path by overflowing from the downstream rinse sump into the upstream rinse path.

4. An apparatus for etching a workpiece, said apparatus comprising:

an etcher having an etchant sump containing an etchant liquid and means for circulating said etchant liquid in a closed etchant path in said etcher, a rinser adjacent said etcher and having a rinse sump containing a rinse liquid and means for circulating said rinse liquid in a closed rinse path in said rinser, means for passing said workpiece first through said etchant path and then through said rinse path, regenerator means connected to said etcher and to said rinser for withdrawing a portion of rinse liquid from said rinser and introducing said portion and a regenerator into said etchant path for replacing lost etchant liquid and restoring the strength thereof, means for replacing in said rinser the rinse water withdrawn as said portion with a substantially equivalent volume of fresh water, another rinser spaced downstream from the first-mentioned rinser in a transport direction and having a downstream rinse sump containing said rinse liquid and means for circulating same in a downstream rinse path in the downstream rinser, said means for replacing being connected to said downstream rinser and said regenerator means being connected to the upstream rinser, and means for withdrawing rinse liquid from said downstream rinser and introducing same into said upstream rinser on withdrawal therefrom of said portion.

5. The apparatus defined in claim 4 wherein said means for withdrawing is an overflow conduit connected between said downstream rinse sump and the upstream rinse sump.

6. The apparatus defined in claim 5 wherein said rinse sumps are horizontally in line and said overflow conduit opens in said downstream rinse sump at a higher location than in said upstream rinse sump.

7. The apparatus defined in claim 4 wherein said regenerator means includes a regenerator tank having a regenerator sump and conduit means for circulating etchant liquid between said etchant sump and said regenerator sump.

8. The apparatus defined in claim 7 wherein said regenerator means includes means for adding regenerator chemicals to said regenerator sump.

* * * * *